US009391410B2

(12) United States Patent
Yu et al.

(10) Patent No.: US 9,391,410 B2
(45) Date of Patent: Jul. 12, 2016

(54) ELECTRICAL CONNECTOR WITH IMPROVED SHELL

(71) Applicant: HON HAI PRECISION INDUSTRY CO., LTD., New Taipei (TW)

(72) Inventors: Chun-Ming Yu, Kunshan (CN); Ji-Chao Wang, Kunshan (CN); Guo-Hua Zhang, Kunshan (CN); Qi-Sheng Zheng, Kunshan (CN); Yi Bu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/463,682

(22) Filed: Aug. 20, 2014

(65) Prior Publication Data

US 2015/0056855 A1 Feb. 26, 2015

(30) Foreign Application Priority Data

Aug. 20, 2013 (CN) ..... 2013 1 0363304
Aug. 20, 2013 (CN) ..... 2013 2 0508263 U

(51) Int. Cl.

*H01R 13/648* (2006.01)
*H01R 13/6594* (2011.01)
*H01R 13/03* (2006.01)
*H01R 24/62* (2011.01)

(52) U.S. Cl.

CPC ..... *H01R 13/6594* (2013.01); *H01R 13/03* (2013.01); *H01R 24/62* (2013.01)

(58) Field of Classification Search

CPC .. H01R 13/516; H01R 13/03; H01R 13/6581; H01R 13/6594; H01R 23/6879; H01R 23/6873; H01R 13/658; H01R 13/6582; H01R 13/65802; H01R 23/025; H01R 23/7073; H01R 12/707; H01R 12/724

USPC ..... 439/607.01, 607.11, 607.13, 607.36, 439/660, 886, 607.07, 607.32, 607.35, 439/607.54, 676, 108

See application file for complete search history.

(56) References Cited

U.S. PATENT DOCUMENTS 6,926,557 B1 * 8/2005 Yamaguchi et al. ..... 439/607.54
7,309,243 B2 * 12/2007 Yamagami ..... 439/83
7,384,310 B2 * 6/2008 Hu ..... H01R 24/64 439/108
7,410,390 B2 * 8/2008 Watanabe ..... H01R 13/65802 439/607.01
7,435,110 B2 10/2008 Xiao et al.
7,563,140 B1 * 7/2009 Wan et al. ..... 439/660

(Continued)

FOREIGN PATENT DOCUMENTS

CN 201498632 U 6/2010
TW 535334 6/2003

(Continued)

*Primary Examiner* — Neil Abrams
*Assistant Examiner* — Travis Chambers
(74) *Attorney, Agent, or Firm* — Wei Te Chung; Ming Chieh Chang

(57) ABSTRACT

An electrical connector, including an insulative housing, a plurality of conductive contacts received in the insulative housing and a metallic shell covering the insulative housing, the shell has a top wall, a bottom wall, a left and a right sidewalls connecting the top wall and the bottom wall, and a rear wall. The rear wall has a first part bent from a rear edge of the left sidewall and extending toward the right sidewall and a second part bent from a rear edge of the right sidewall and extending toward the left sidewall. Both the first and the second parts have a mounting leg extending downwardly, and the right and the left sidewalls have retaining legs.

17 Claims, 11 Drawing Sheets

(56) References Cited

U.S. PATENT DOCUMENTS

| | | | | |
|---|---|---|---|---|
| 7,682,172 | B2 * | 3/2010 | Lu | H01R 13/6485 439/181 |
| 2007/0238330 | A1 * | 10/2007 | Xiao et al. | 439/101 |

FOREIGN PATENT DOCUMENTS

| | | |
|---|---|---|
| TW | M326256 | 1/2008 |
| TW | M450099 | 4/2013 |

* cited by examiner

ELECTRICAL CONNECTOR WITH IMPROVED SHELL

BACKGROUND OF THE INVENTION

1. Field of the Invention

The present invention relates to electrical connectors, more particularly to an electrical connector with improved shell.

2. Description of Related Art

USB (Universal Serial Bus) connectors are popular used in electronic equipments. USB Implementers Forum, Inc has developed many USB specifications, including: USB 1.0 specification, USB 1.1 specification, USB 2.0 specification, and USB 3.0 specification recently. To meet the market requirements, USB Implementers Forum, Inc needs to improve their specification and connectors defined in the specification, so as to provide a high transmitting speed.

Usually, a high transmitting speed may cause a more heavy EMI problem, and the shell needs a well grounding configuration, U.S. Pat. No. 7,435,110 discloses a connector, which has an insulative housing, a plurality of contacts received in the insulative housing and a shell covering the insulative housing. The insulative housing has a main body and a tongue plate extending into the main body and a position seat mounted to a rear of the main body. The contact a retaining portion retained in the main body, a contacting portion extending into the tongue plate from the retaining portion, an extending portion extending from the retaining portion vertically and downwardly to be received in the position seat and a soldering portion extending downwardly from the extending portion. The shell has a top wall, a bottom wall, two sidewalls connecting the top and the bottom walls, and a rear wall bent from the top wall, a receiving space is defined by the top wall, the bottom wall, the rear wall and the sidewalls. The sidewall has a mounting leg extending downwardly, and the rear wall has two another mounting legs extending downwardly, these mounting legs are mounted to a printed circuit board, which the electrical connector is mounted to, to establish grounding paths.

However, when plating the mounting legs before bending the shell, since the mounting legs of the rear wall are located on a rear side, while the mounting legs of the sidewalls are located on a right or a left side, so the mounting legs of the rear wall needs separated plated.

Hence, an improved electrical connector is desired to overcome the above problems.

BRIEF SUMMARY OF THE INVENTION

According to one aspect of the present invention, an electrical connector comprises an insulative housing, a plurality of contacts received in the insulative housing and a shell covering the insulative housing. The shell has a top wall, a bottom wall, two sidewalls connecting the top wall and the bottom wall, and a rear wall shielding a rear end of the insulative housing. The top wall, the bottom wall, and the two sidewalls define an inserting port together. The rear wall has a mounting leg extending downwardly beyond the bottom wall, and the rear wall is bent from a vertical edge of one of the sidewalls and horizontally extends toward the other sidewall.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
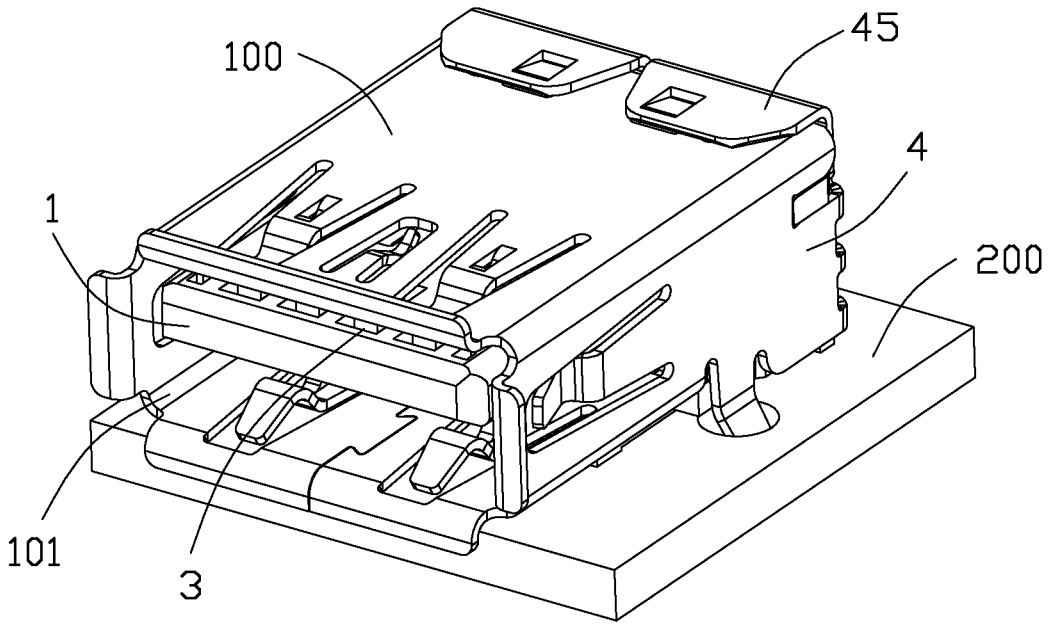
FIG. 1 is an assembled, perspective view of an electrical connector mounted to a printed circuit board, according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-4, an electrical connector 100 similar with USB 3.0 connector is disclosed. The electrical connector 100 has a same mating interface as that of USB 3.0 receptacle type A, which is mounted to a printed circuit board 200 and mates with a USB 2.0 plug type A or a USB 3.0 plug type A. The electrical connector 100 includes an insulative housing 1, a spacer 2 retained to the insulative housing 1, and a plurality of contacts 3 received in the insulative housing 1 and a metallic shell 4 covering the insulative housing 1.

Figure 3:
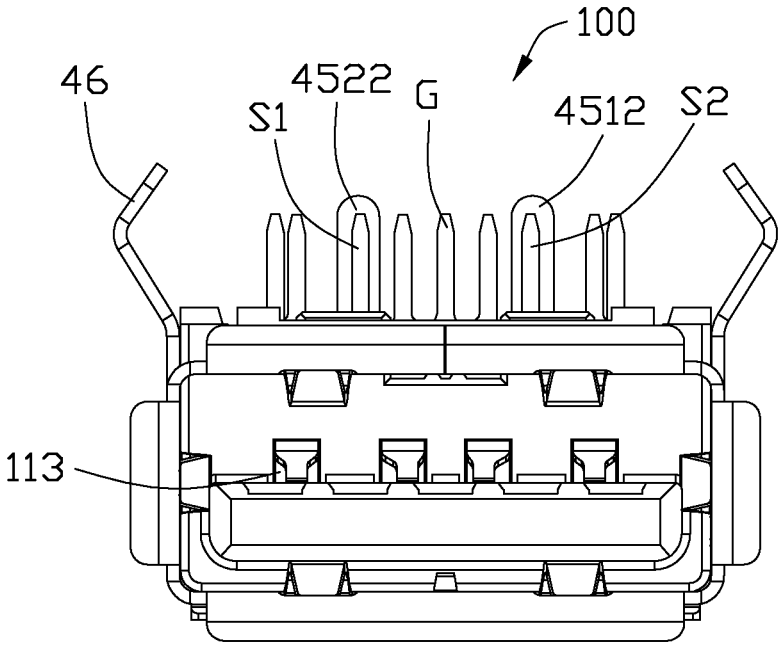
FIG. 3 is a perspective view of the electrical connector taken from a bottom side.
Figure 4:
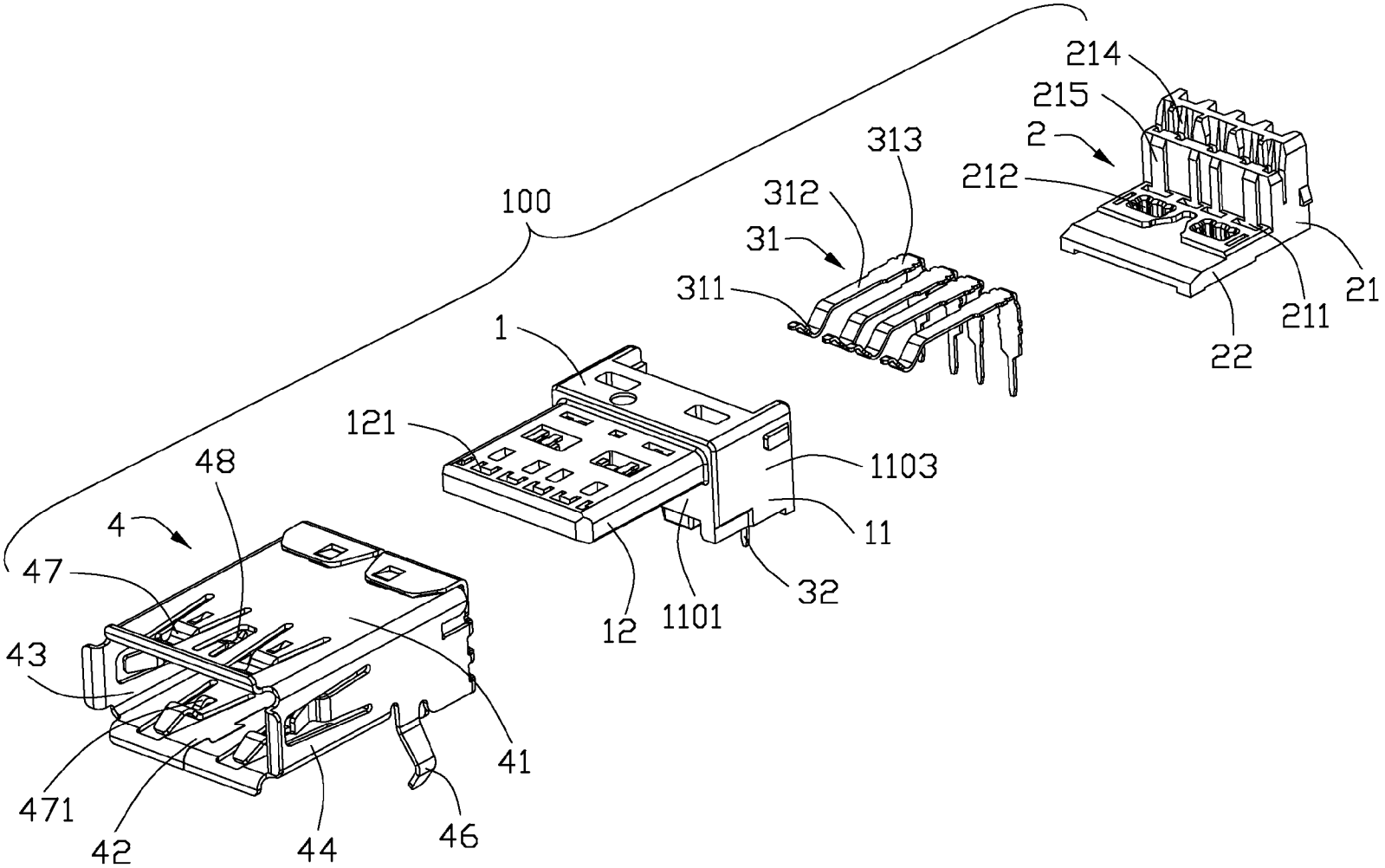
FIG. 4 is an exploded, perspective view of the electrical connector
Figure 5:
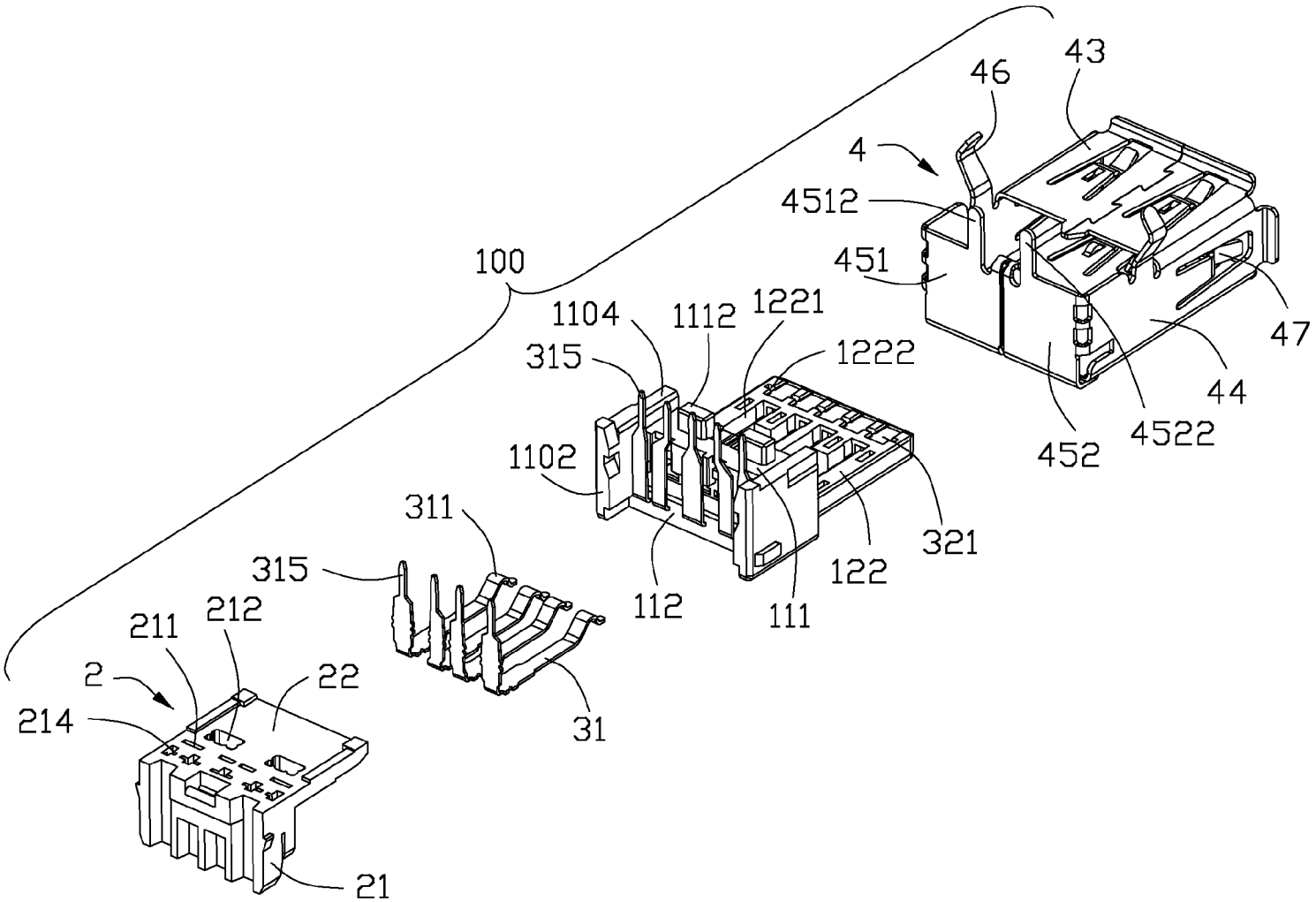
FIG. 5 is a view similar to FIG. 4.

Referring to FIGS. 3-5, the insulative housing 1 has a main body 11 and a tongue 12 extending forwardly from the main body 11. The main body 11 has a rectangular body, including a front end face 1101 connecting with the tongue 12, a rear end face 1102 opposite to the front end face 1101, two side end faces 113 between the front end face 1101 and the rear end face 1102, and a bottom face 1104 below the main body 11. The main body 11 has a recess 111 on the bottom face 1104 and a mounting space 112, the recess 111 passes through the front end face 1101. A pair of posts 1112 are disposed on the recess 111. The tongue 12 has a top surface 121 and an opposite bottom surface 122. The bottom surface 122 defines four first contact passageways 1221 and five second contact passageways 1222 in front of the first contact passageways 1221.

Referring to FIG. 3 and FIG. 5, the spacer 2 has a base 21 received in the mounting space 12 of the main body 11, and a supporting portion 22 extending from a bottom of the base 21. The supporting portion 22 has a plurality of first contact receiving slots 211 passing therethrough along an upper to bottom direction, and a pair of through holes 212 in front of the first contact receiving slots 211. The base 21 further has a plurality of second contact receiving slots 214 also passing there through along the upper to bottom direction and behind the contact receiving slots 211, and a plurality of ribs 215 protruding forwardly and corresponding to the first contact receiving slots 211. The supporting portion 22 is received in the recess 111 of the main body 11 and extends forwardly beyond the recess 111, and the posts 1112 of the main body 11 are received in the through holes 212 of the supporting portion 22.

Figure 6:
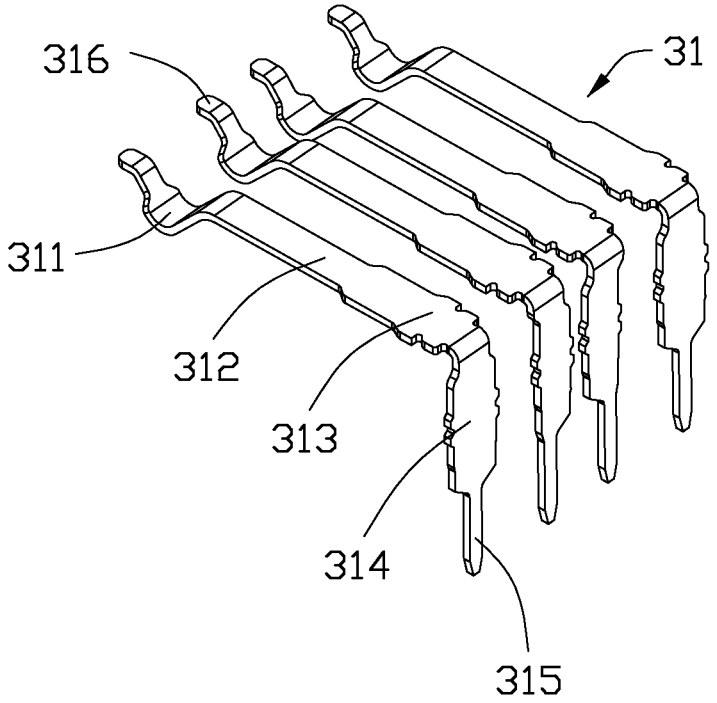
FIG. 6 is a perspective view of first contacts of the electrical connector.

Referring to FIGS. 4-7, the contacts 3 are complied to USB 3.0 specification and have four first contacts 31 and five second contacts 32 insert molded in the insulative housing 1. The first contacts 31 include a power contact, a negative differential signal contacts, a positive differential signal contacts and a grounding contact. Referring to FIG. 6, each of the first contacts 31 has a first retaining portion 313 retained to the main body 11, a first extending portion 312 extending forwardly from the first retaining portion 313 to the first contact passageway 1221 of the tongue 12, an arc first contacting portion 311 extending forwardly from the first extending portion 312 and being elastic, and a protruding portion 316 further extending forwardly from the first contacting portion 311, a first latching portion 314 received in the first contact receiving slot 211 of the spacer 2 and a first soldering portion 315 extending beyond the spacer 2. The rib 215 forwardly abuts against the first latching portion 314 of the first contact 31.

Figure 7:
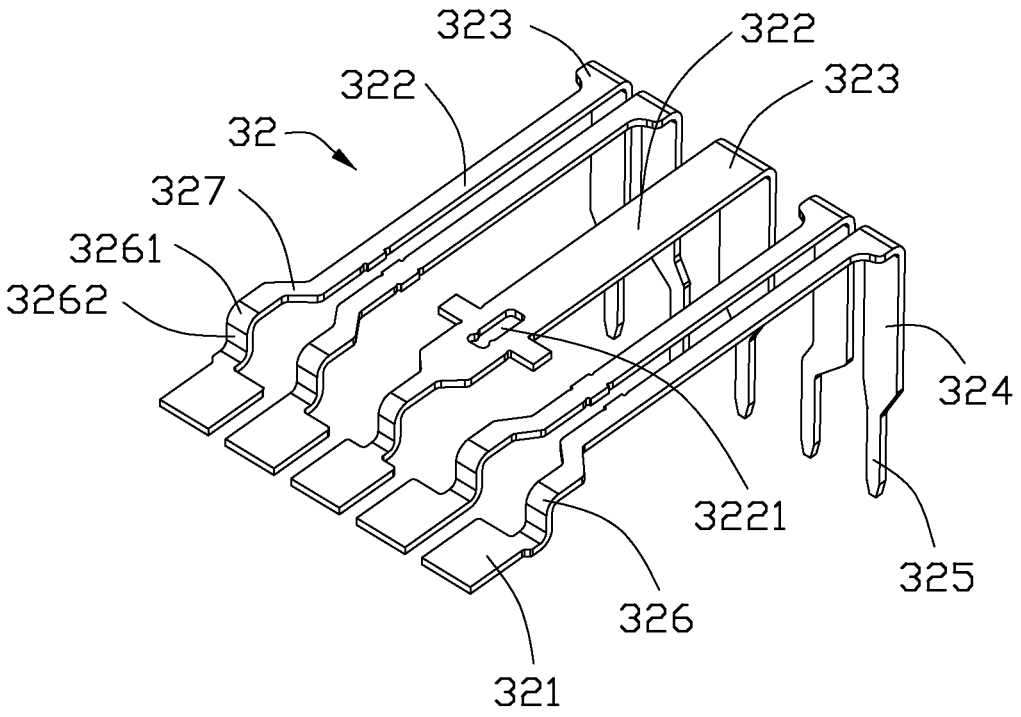
FIG. 7 is a perspective view of second contacts of the electrical connector.

Referring to FIG. 7, the second contacts 32 include two pairs of differential signal contacts (S1, S2), and a grounding contact G between the two pairs. Each of the second contacts 32 has a second retaining portion 323 retained to the main body 11, a second extending portion 322 extending forwardly from the second retaining portion 323, an planar second contacting portion 321 extending forwardly from the second extending portion 322 to the second contact passageway 1222 of the tongue 12, and a connecting portion 326 connecting the second extending portion 322 and the second contacting portion 321, a second latching portion 324 extending from the second retaining portion 323 and downwardly received in the second contact receiving slot 214 of the spacer 2 and a second soldering portion 325 extending beyond the spacer 2.

An offset portion 327 is formed between the connecting portion 326 and the second extending portion 322 of each of the differential signal contacts S1, S2. The connecting portion 326 is formed with a horizontal part 3261 and a vertical part 3262 vertically bent from the horizontal part 3261.

The second contact portion 321 extends from the vertical part 3262, the second contacting portion 321 is below the second extending portion 322 and parallel to the second extending portion 322. To one pair of the differential signal contacts S1/S2, the offsets 327 deflect away from each other from corresponding second extending portion 322, so that a distance between the two horizontal parts 3261 is larger than that of the two second extending portions 322. The grounding contact G defines a through slot 3221 on the second extending portion 322 thereof All the contacting portions 321 of the differential signal contacts S1, S2 deflect toward the grounding contact G.

Figure 2:
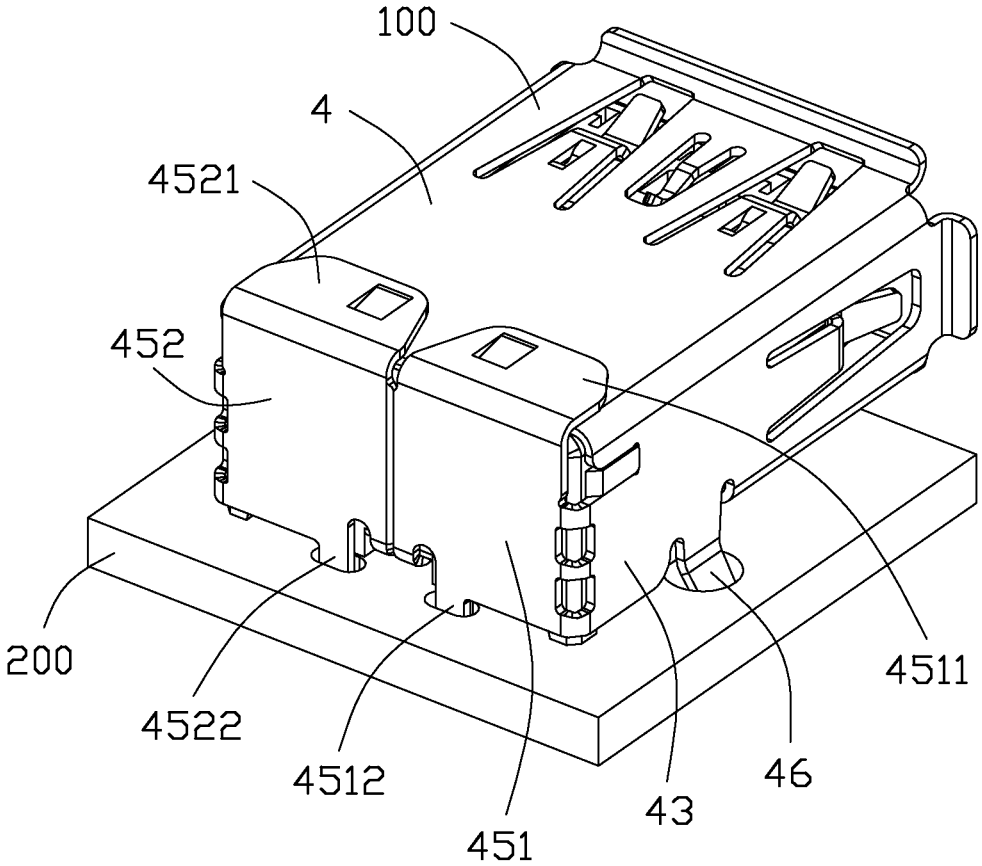
FIG. 2 is another perspective view of the electrical connector.

Referring to FIGS. 1, 4-8, the shell 4 has a top wall 41, a bottom wall 42, a left sidewall 43 and a right sidewall 44 connecting the top wall 41 and the bottom wall 42, and a rear wall 45 shielding a rear side of the insulative housing 1. The top wall 41, the right and the left sidewall 43, 44 all extend rearward beyond the bottom wall 42, the top wall 41, the right and the left sidewall 43, 44 together define an inserting port 101 (referring to FIG. 1) for a mating plug (not shown). The rear wall 45 has a first part 451 bent from a vertical rear edge of the left sidewall 43 and extending toward the right sidewall 44 and a second part 452 bent from a vertical rear edge of the right sidewall 44 and extending toward the left sidewall 43. Referring to FIG. 2, the first and the second parts 451, 452 together shield an opposite end of the inserting port 101, the first and the second parts 451, 452 are provided with a plurality of pressing portions 4511, 4521 extending horizontally and forwardly from top edges thereof to press against the top wall 41.

Rear parts of the left and the right sidewall 43, 44 extend rearward beyond the bottom wall 42 and have retaining legs 46 extending downwardly beyond the bottom wall 42 to mount on a printed circuit board 200. Each of the top wall 41, the bottom wall 42, the left sidewall 43 and a right sidewall 44 has one or one pair elastic pieces 47 protruding into the inserting port 101, and the top wall 41 further has a resisting arm 48 between the pair of elastic pieces 47, the resisting arm 48 has an opposite extending direction relative to that of the elastic pieces 47. The elastic piece 47 of the top wall 41 and the bottom wall 42 is tore to form a strip 471 on a root part thereof.

The first part 451 and the second part 452 of the rear wall 45 has a first and a second mounting legs 4512, 4522 extending downwardly and perpendicularly, respectively, to be soldered to the printed circuit board 200 to achieve a grounding function. The first and the second parts 451, 452 are symmetrical to a vertical center line of the shell 4, and the first and the second mounting legs 4512, 4522 are also symmetrical to the vertical center line of the shell 4. The first and the second mounting legs 4512, 4522 are aligned with two signal contacts S1, S2 adjacent to the grounding contact G along a front to back direction, so the two signal contacts S1, S2 have a smallest distance to the corresponding mounting legs 4512, 4522, and that can ensure cross talking caused by high speed transition can leave the shell 4 by the mounting legs 4512, 4522 in time.

Figure 8:
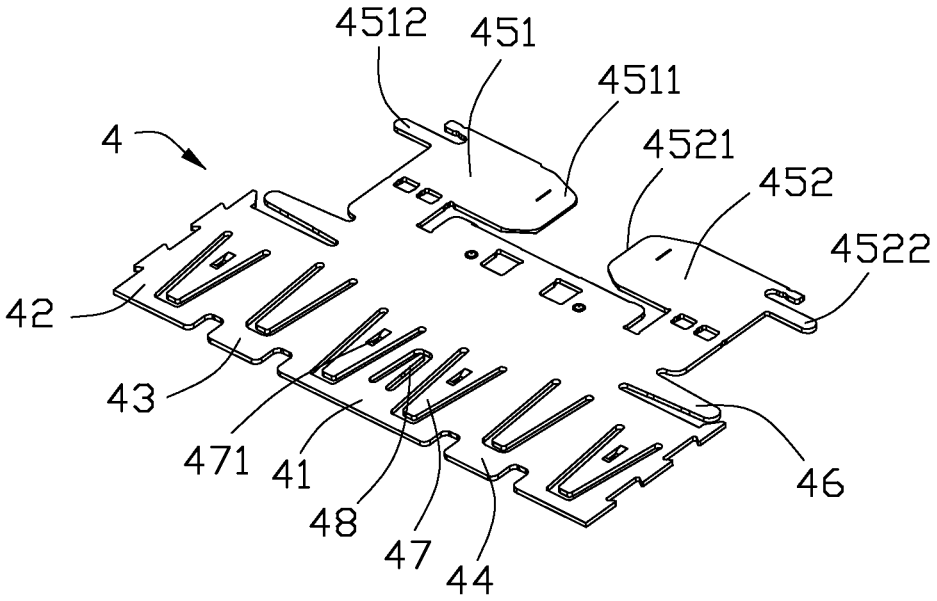
FIG. 8 is a perspective view of a shell of the electrical connector.

Referring to FIG. 8, the shell 4 is stamped from a metal piece and then bent to form the inserting port 101, after forming the inserting port 101, the rear wall 45 is not bent from the sidewall 43, 44, the first part 451 is located in a same plane with the left sidewall 43, and the second part 452 is located in a same plane with the right sidewall 44, the mounting legs 4512, 4522 and the retaining legs 46 are all below the bottom wall 42, so the shell 4 can be put into the plating pool and plate these legs 4512, 4522, 46 at the same time, that can improve plating process feasibility and plating efficiency, in present embodiment, these legs 4512, 4522, 46 are wholly plated with nickel, and selectively plated with tin, a solderable material, at the place to be soldered.

Figure 9:
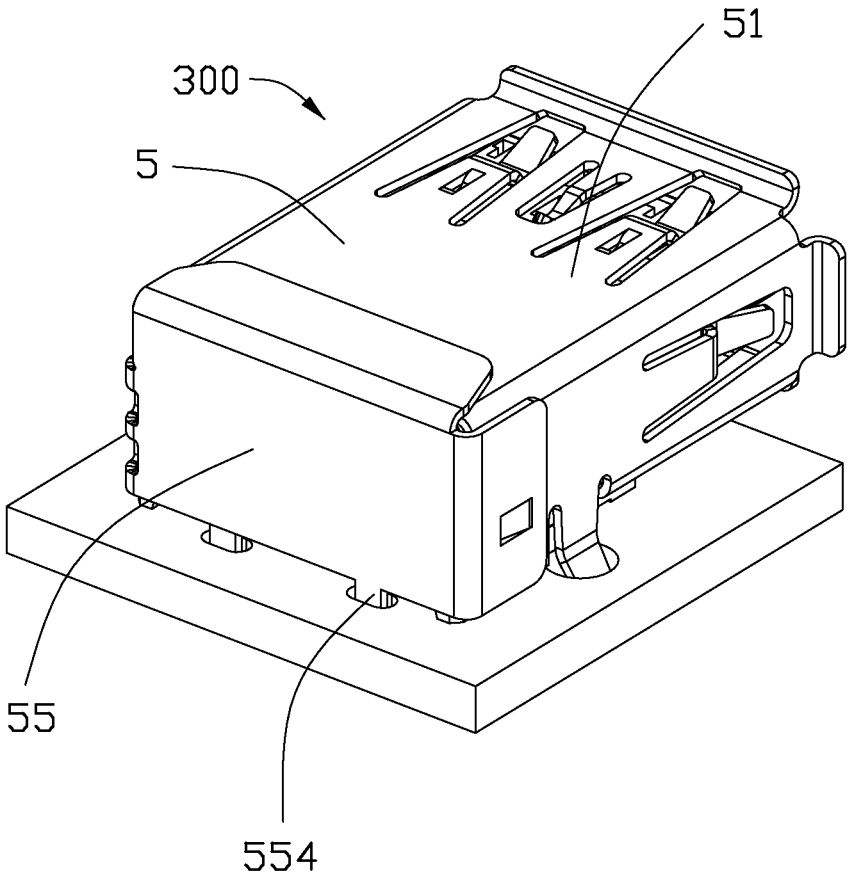
FIG. 9 is an assembled, perspective view of another electrical connector in alternative embodiment according to the present invention.
Figure 10:
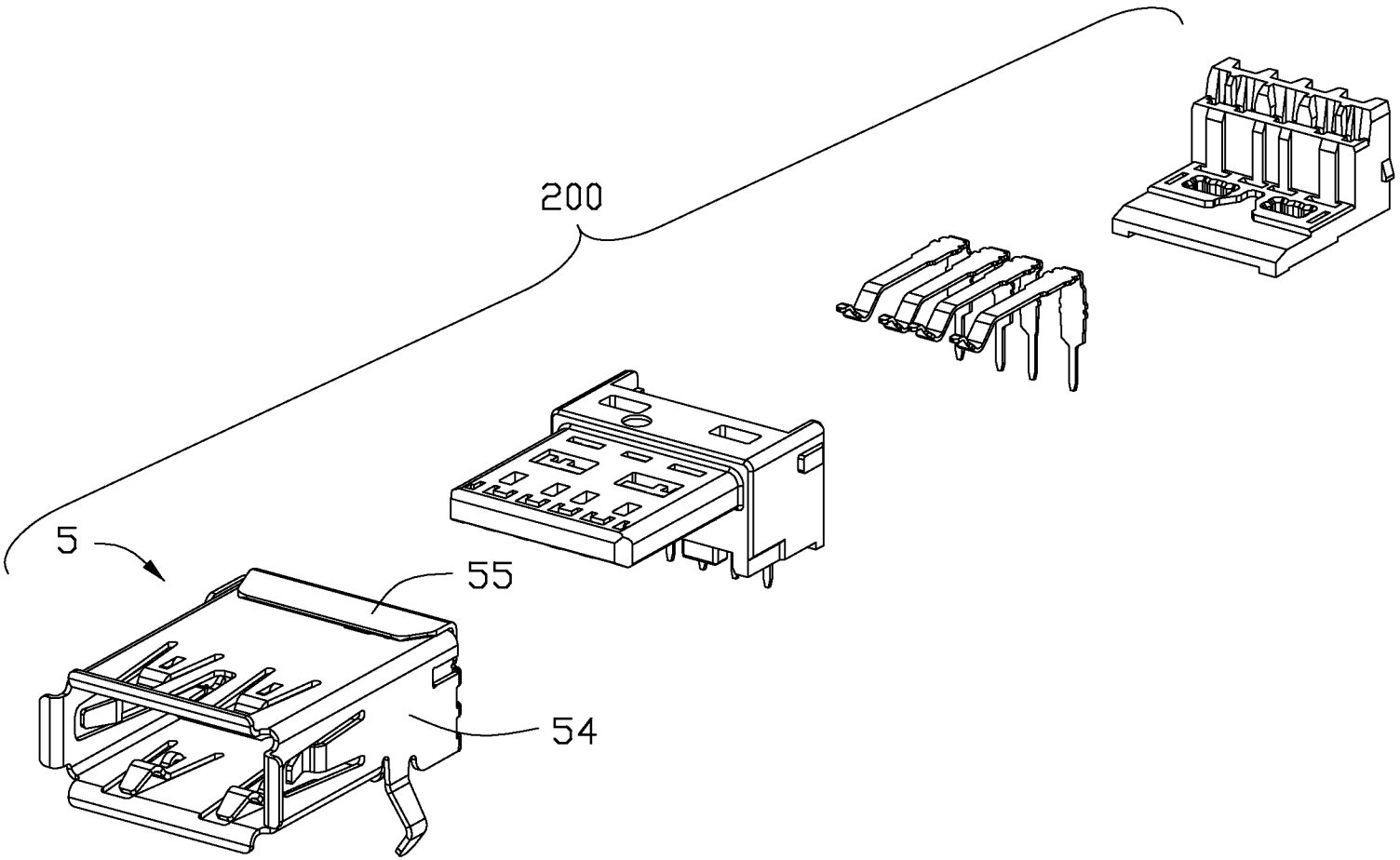
FIG. 10 is an assembled, perspective view of the electrical connector in FIG. 9.
Figure 11:
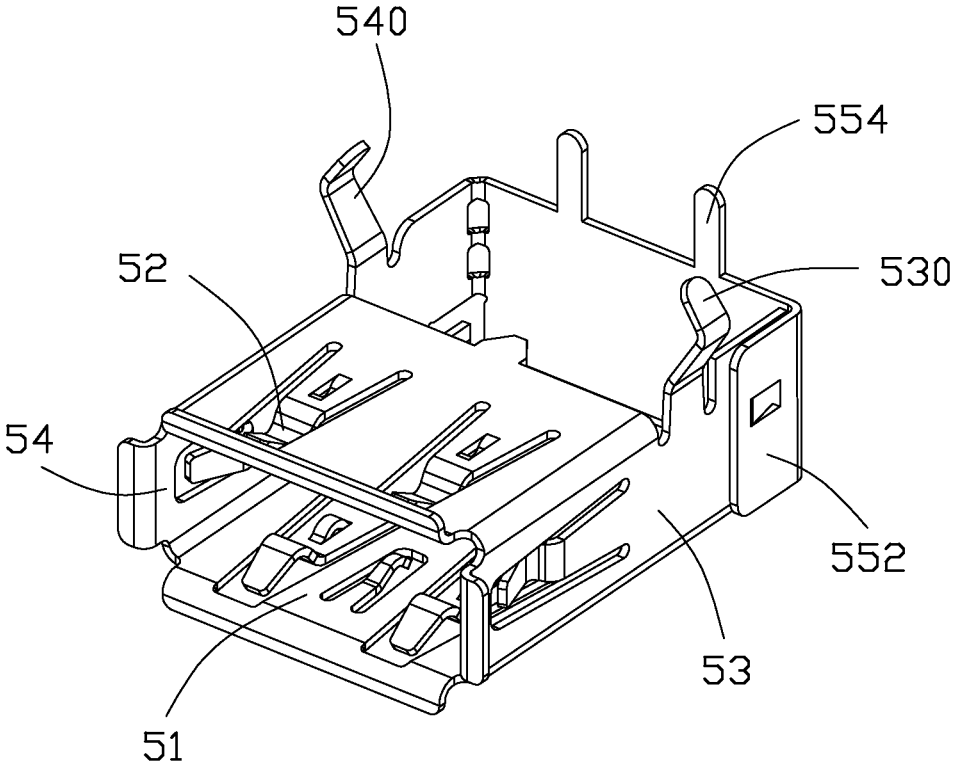
FIG. 11 is a perspective view of a shell of the electrical connector in FIG. 9.

FIGS. 9-11 discloses another electrical connector 300 in alternative embodiment according to present invention. The electrical connector 300 is similar with the electrical connector 100, and has a same insulative housing, a same contacts, a same spacer, and a similar shell 5. The shell 5 has a top wall 51, a bottom wall 52, a left sidewall 53 and a right sidewall 54 connecting the top wall 51 and the bottom wall 52, and a rear wall 55 shielding a rear side of the insulative housing. The shell 5 is substantially same as the shell 4 in the electrical connector 100, except the rear wall 55, different from the rear wall 45 including the first part and the second part, the rear wall 55 only has one piece, which is bent from a vertical rear edge of the right sidewall 54 and extending toward the left sidewall 53. The rear wall 55 has two pressing portions 552 pressing the top wall 51 and the left sidewall 53, respectively. The left and the right sidewall 53, 54 have retaining legs 530, 540 extending downwardly beyond the bottom wall 52, the rear wall 55 has two mounting legs 554 extending downwardly. The position of the mounting legs 554 is same as the mounting legs 4512, 4522, here will not give more unnecessary description. the shell 5 is stamped from a metal piece, before the rear wall 55 is not bent from the sidewall 54, the rear wall 55 is located in a same plane with the right sidewall 54, the mounting legs 554 and the retaining legs 530, 540 are all below the bottom wall 52, so the shell 5 can be put into the plating pool and plate these legs 554, 530, 540 at the same time, that can improve plating process feasibility and plating efficiency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulative housing;

a plurality of contacts received in the insulative housing; and a shell covering the insulative housing, the shell having a top wall, a bottom wall, two sidewalls connecting the top wall and the bottom wall, and a rear wall shielding a rear face of the insulative housing, the top wall, the bottom wall, and the two sidewalls defining an inserting port together, the rear wall having a mounting leg extending downwardly beyond the bottom wall, and the rear wall being bent from a rear vertical edge of one of the sidewalls and horizontally extending toward the other sidewall, wherein the rear wall has pressing portions pressing the top wall and the other sidewall, respectively.

2. The electrical connector as claimed in claim 1, wherein the rear wall fully shields the rear face of the housing in a transverse direction.

3. The electrical connector as claimed in claim 1, wherein the mounting legs is plated with a solderable material.

4. The electrical connector as claimed in claim 3, wherein each of the sidewalls has a retaining leg extending downwardly beyond the bottom wall and is also plated.

5. The electrical connector as claimed in claim 4, wherein rear parts of the sidewalls extend rearward beyond the bottom wall, and the retaining legs extend from the rear part downwardly beyond the bottom wall.

6. An electrical connector comprising:

an insulative housing;

a plurality of contacts received in the insulative housing; and a shell covering the insulative housing, the shell having a top wall, a bottom wall, a left and a right sidewalls connecting the top wall and the bottom wall, and a rear wall shielding a rear face of the insulative housing, the top wall, the bottom wall, and the left and the right sidewalls defining an inserting port together, the rear wall formed with a first part and a second part, each part having a mounting leg extending downwardly beyond the bottom wall, and the first part being bent from a vertical rear edge of the left sidewall and extending toward the right sidewall and the second part being bent from a vertical rear edge of the right sidewall and extending toward the left sidewall, wherein the first and the second part are provided with pressing portions extending horizontally and forwardly from top edges thereof to press against the top wall.

7. The electrical connector as claimed in claim 6, wherein the first and the second parts are symmetrical to a vertical center line of the shell.

8. The electrical connector as claimed in claim 6, wherein the mounting legs are symmetrical to the vertical center line of the shell.

9. The electrical connector as claimed in claim 6, wherein the mounting legs is plated with a solderable material.

10. The electrical connector as claimed in claim 6, wherein each of the left and the right sidewalls has a retaining leg extending downwardly beyond the bottom wall and is also plated.

11. The electrical connector as claimed in claim 6, wherein the rear wall fully shields the rear face of the housing in a transverse direction.

12. An electrical connector comprising:

an insulative housing equipped with a plurality of conductive contacts therein;

a metallic shield enclosing the housing in a fastened manner, said shield formed by sheet metal and forming at least a horizontal top wall to cover a top surface of the housing, two opposite vertical side walls unitarily extending from two opposite lateral side edges of the top wall to cover two opposite side surfaces of the housing, and a vertical rear wall unitarily extending from a rear edge of at least one of said vertical side walls to cover a rear face of the housing; wherein each of said two opposite vertical side walls and said rear wall further includes a mounting leg downwardly extending from a bottom edge thereof for mounting to a printed circuit board, said mounting leg being plated with solderable material which is not applied to remaining portions of the shield, wherein the rear wall further includes a pressing portion fastened to the top wall.

13. The electrical connector as claimed in claim 12, wherein the mounting leg of the rear wall and the mounting leg of the corresponding side wall from which the rear wall unitarily extends, is plated with said solderable material at a same time while the mounting leg of another side wall is plated with said solderable material at another time.

14. The electrical connector as claimed in claim 12, further including an insulative spacer to align tails of the contacts in a vertical direction, wherein the rear wall further includes an engagement tab, around a bottom edge thereof, received in a corresponding recess of the spacer.

15. The electrical connector as claimed in claim 12, wherein the rear wall fully covers the rear face of the housing in a transverse direction.

16. The electrical connector as claimed in claim 12, wherein the rear wall includes two parts each extending from the corresponding one of said two opposite side walls toward the other, and each of said two parts includes the corresponding mounting leg.

17. The electrical connector as claimed in claim 16, wherein the mounting legs of the two parts of the rear wall are plated with the solderable material at a same time with those of the corresponding side walls from which said part of the rear wall unitarily extend, respectively.

* * * * *